US007987684B2

(12) United States Patent
Jeong et al.

(10) Patent No.: US 7,987,684 B2
(45) Date of Patent: Aug. 2, 2011

(54) REFRIGERATOR WITH AIR GUIDE DUCT

(75) Inventors: Jin Jeong, Yongin-si (KR); June Kee Min, Seongnam-si (KR); Yong Pil Park, Suwon-si (KR); Sun Gyou Lee, Gwangju (KR); Chang Hak Lim, Hwaseong-si (KR); In Sub Lee, Suwon-si (KR); Won Jae Yoon, Seoul (KR); Yong Han Kim, Cheonan-si (KR); Yeo Wool Jung, Busan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 171 days.

(21) Appl. No.: 11/984,308

(22) Filed: Nov. 15, 2007

(65) Prior Publication Data

US 2008/0223063 A1 Sep. 18, 2008

(30) Foreign Application Priority Data

Mar. 12, 2007 (KR) ..... 10-2007-0024222

(51) Int. Cl.
*F25D 17/04* (2006.01)

(52) U.S. Cl. ..... 62/407

(58) Field of Classification Search ..... 62/291, 62/277, 407, 408, 412, 419
See application file for complete search history.

(56) References Cited

U.S. PATENT DOCUMENTS 3,785,168 A * 1/1974 Domingorene ..... 62/455
6,629,429 B1 * 10/2003 Kawamura et al. ..... 62/441

FOREIGN PATENT DOCUMENTS

KR 10-2005-0119454 12/2005

* cited by examiner

*Primary Examiner* — Melvin Jones
(74) *Attorney, Agent, or Firm* — Staas & Halsey LLP

(57) ABSTRACT

Disclosed is a refrigerator in which a space occupied by an evaporating dish can be minimized, evaporation efficiency of defrost water by convection-heat transfer can be improved, air can be easily exhausted in a machine room, and thus the cooling efficiency of a compressor and a condenser can be improved. The refrigerator includes: a cooling apparatus including a compressor, a condenser, and an evaporator; a blowing fan blowing air to cool at least one of the compressor and the condenser; a blowing guide duct guiding the air blown by the blowing fan to an exterior; and an evaporating dish installed in a lower portion of the blowing guide duct in order to collect and evaporate defrost water, the evaporating dish having an opened upper portion to communicate with a path of the blowing guide duct.

10 Claims, 4 Drawing Sheets

REFRIGERATOR WITH AIR GUIDE DUCT

CROSS-REFERENCE TO RELATED APPLICATIONS

This application claims the benefit of Korean Patent Application No. 10-2007-0024222, filed on Mar. 12, 2007, in the Korean Intellectual Property Office, the disclosure of which is incorporated herein by reference

BACKGROUND

1. Field

The present invention relates to a refrigerator, and more particularly, to a refrigerator capable of improving evaporation efficiency of defrost water.

2. Description of the Related Art

A refrigerator has a cooling apparatus to cool a storing chamber. Conventionally, a cooling apparatus of a refrigerator includes a compressor compressing refrigerant, a condenser condensing the compressed refrigerant, an expander expanding the condensed refrigerant, and an evaporator evaporating the expanded refrigerant to cool the storing chamber.

Since the compressor and the condenser must cool the storing chamber using external air, they are installed in a machine room separated from the storing chamber. In addition, the machine room includes both a blowing fan blowing air in order to cool the compressor and the condenser, and an evaporating dish in order to evaporate defrost water that has dropped down from the evaporator.

For example, Korean Unexamined Patent Publication No. 2005-0119454 discloses a refrigerator in which a cooling fan, a condenser, an evaporating dish (evaporating vessel), and a compressor are sequentially installed from one side of a machine room. The evaporating dish adheres closely to the side of the compressor. Such a refrigerator heats defrost water of the evaporating dish by using the heat of the compressor, thereby evaporating the defrost water. Further, the refrigerator causes the air blown by a cooling fan to flow toward the evaporating dish after the temperature of the air has been increased while passing through the condenser, thereby improving the evaporation efficiency of defrost water by convection-heat transfer.

However, in such a refrigerator, since the air flowing toward the evaporating dish by the cooling fan is diffused inside the machine room, the speed of air flowing above the surface of the defrost water becomes slow, and thus the convection-heat transfer efficiency for evaporation of the defrost water is deteriorated. Accordingly, in such a refrigerator, the size of the evaporating dish is increased in order to increase the contact area between the defrost water and the air flowing above the defrost water. However, in such a case, since a space occupied by the evaporating dish in the machine room increases, the parts of the machine room may not be efficiently arranged. Further, airflow may interfere with the evaporating dish.

Moreover, in such a refrigerator, since the air blown by the cooling fan is diffused inside the machine room, the air is not easily exhausted from the machine room. This may decrease the cooling efficiency of the compressor and the condenser, resulting in efficiency deterioration.

SUMMARY

Accordingly, it is an aspect of the present embodiment to provide a refrigerator capable of minimizing a space occupied by an evaporating dish and improving evaporation efficiency of defrost water by convection-heat transfer.

It is another aspect of the present embodiment to provide a refrigerator capable of improving the cooling efficiency of a compressor and a condenser by facilitating air exhaustion in a machine room.

Additional aspects and/or advantages will be set forth in part in the description which follows and, in part, will be apparent from the description, or may be learned by practice of the invention.

The foregoing and/or other aspects are achieved by providing a refrigerator including a cooling apparatus including at least a compressor, a condenser, and an evaporator; a blowing fan blowing air to cool at least one of the compressor and the condenser; a blowing guide duct guiding the air blown by the blowing fan to an exterior; and an evaporating dish installed in a lower portion of the blowing guide duct in order to collect and evaporate defrost water, the evaporating dish having an opened upper portion to communicate with a path of the blowing guide duct.

According to an aspect of the present embodiment, the evaporating dish is integrally formed with the blowing guide duct.

According to an aspect of the present embodiment, the evaporating dish includes a refrigerant pipe to heat the defrost water.

According to an aspect of the present embodiment, the blowing guide duct includes a defrost water guide pipe guiding the defrost water into the evaporating dish.

Further, according to an aspect of the present embodiment, the blowing fan includes a centrifugal fan, and the blowing guide duct includes a fan casing surrounding the blowing fan.

The foregoing and/or other aspects are achieved by providing a refrigerator including a body having a storing chamber; a machine room installed at a lower rear portion of the body and partitioned from the storing chamber; an air feeding path formed in a lower portion of the body to introduce external air into the machine room; an air exhausting path formed in the lower portion of the body to exhaust the air out of the machine room; a condenser installed in the air feeding path; a compressor installed at an outlet of the air feeding path in the machine room; a blowing fan installed in the machine room to blow the air passing through the condenser and the compressor to the air exhausting path; a blowing guide duct guiding the air blown by the blowing fan to the air exhausting path; and an evaporating dish installed in a lower portion of the blowing guide duct in order to collect and evaporate defrost water, the evaporating dish having an opened upper portion to communicate with a path of the blowing guide duct.

The foregoing and/or other aspects are achieved by providing a blowing guide duct collecting and evaporating defrost water in a refrigerator including an evaporator, including: a defrost water guide pipe guiding defrost water flowing from the evaporator and receiving blowing air; an evaporating dish collecting the defrost water guided by the defrost water guide pipe; and a refrigerant pipe passing through the evaporating dish and heating the defrost water so the defrost water is evaporated, where the blowing guide duct has an air outlet to exhaust air toward an air exhausting path.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
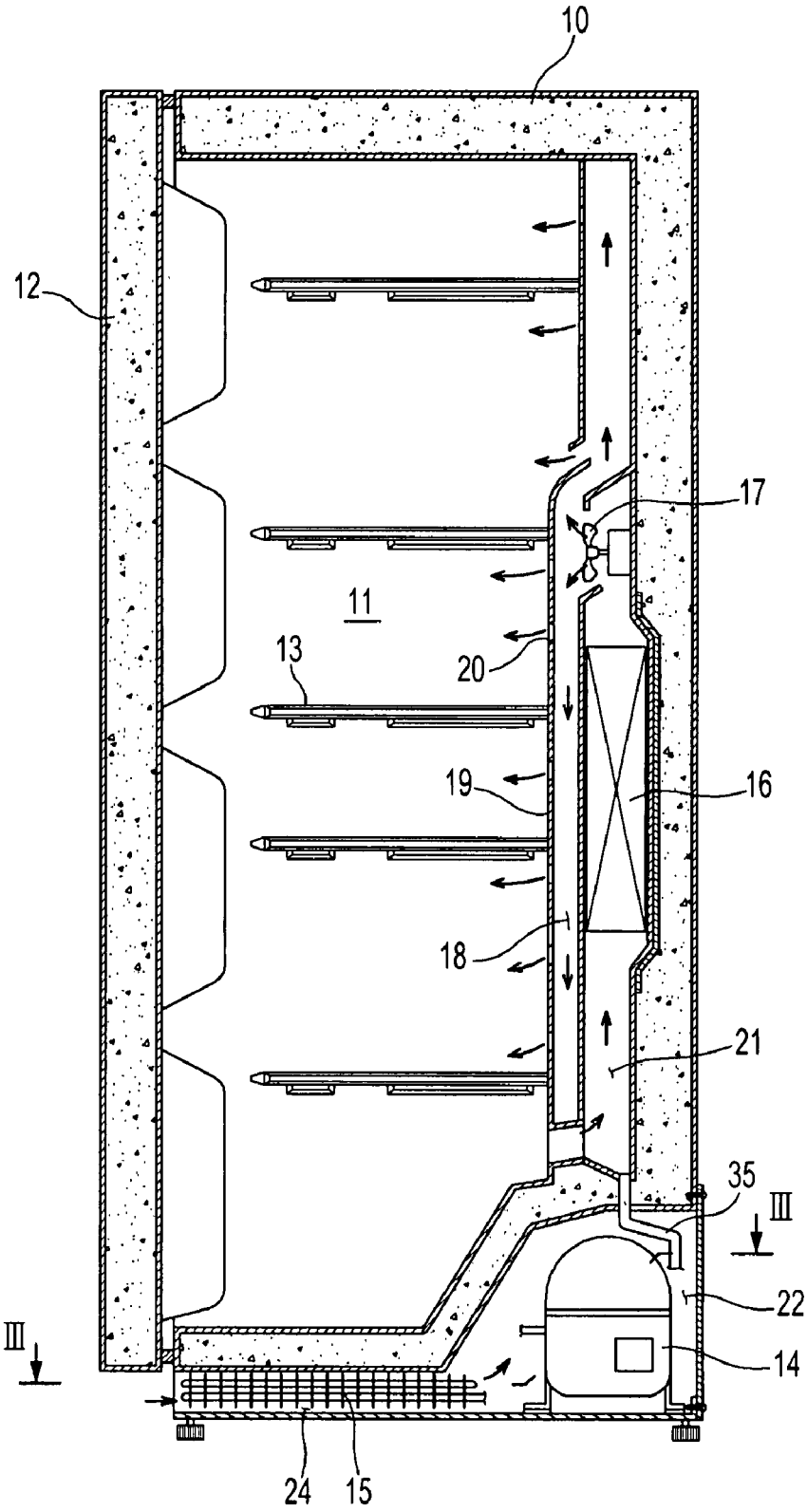
FIG. 1 is a sectional view illustrating a refrigerator according to the present embodiment.

Reference will now be made in detail to the embodiment, examples of which are illustrated in the accompanying drawings, wherein like reference numerals refer to the like elements throughout. The embodiment is described below to explain the present invention by referring to the figures.

As illustrated in FIG. 1, a refrigerator according to the present embodiment includes a body 10 having a storing chamber 11 to store foods, etc. The storing chamber 11 has an opened front surface, and a front surface of the body 10 is provided with a door 12 to open or close the storing chamber 11. The storing chamber 11 has a plurality of shelves 13 to store goods or foods in multiple rows.

The storing chamber 11 is cooled by a cooling apparatus. The cooling apparatus includes a compressor 14 compressing refrigerant, a condenser 15 condensing the compressed refrigerant, an expander (not shown) expanding the condensed refrigerant in a low pressure, and an evaporator 16 evaporating the expanded refrigerant.

The evaporator 16 cools the air of the storing chamber 11 through heat exchange with the air of the storing chamber 11. As illustrated in FIG. 1, the evaporator 16 is installed at an inner rear portion of the storing chamber 11 adjacent to a rear wall of the body 10. A cold air circulation fan 17 is installed at an upper portion of the evaporator 16 in order to circulate the air of the storing chamber 11 via the evaporator 16. Further, an inner panel 19 is installed at a front of the evaporator 16 in order to partition a space, in which the evaporator 16 is installed, from the storing chamber 11 and to form a cold air circulation path 18. The inner panel 19 is provided with a plurality of outlets 20 to dispersively exhaust the air of the cold air circulation path 18 to the storing chamber 11.

Figure 2:
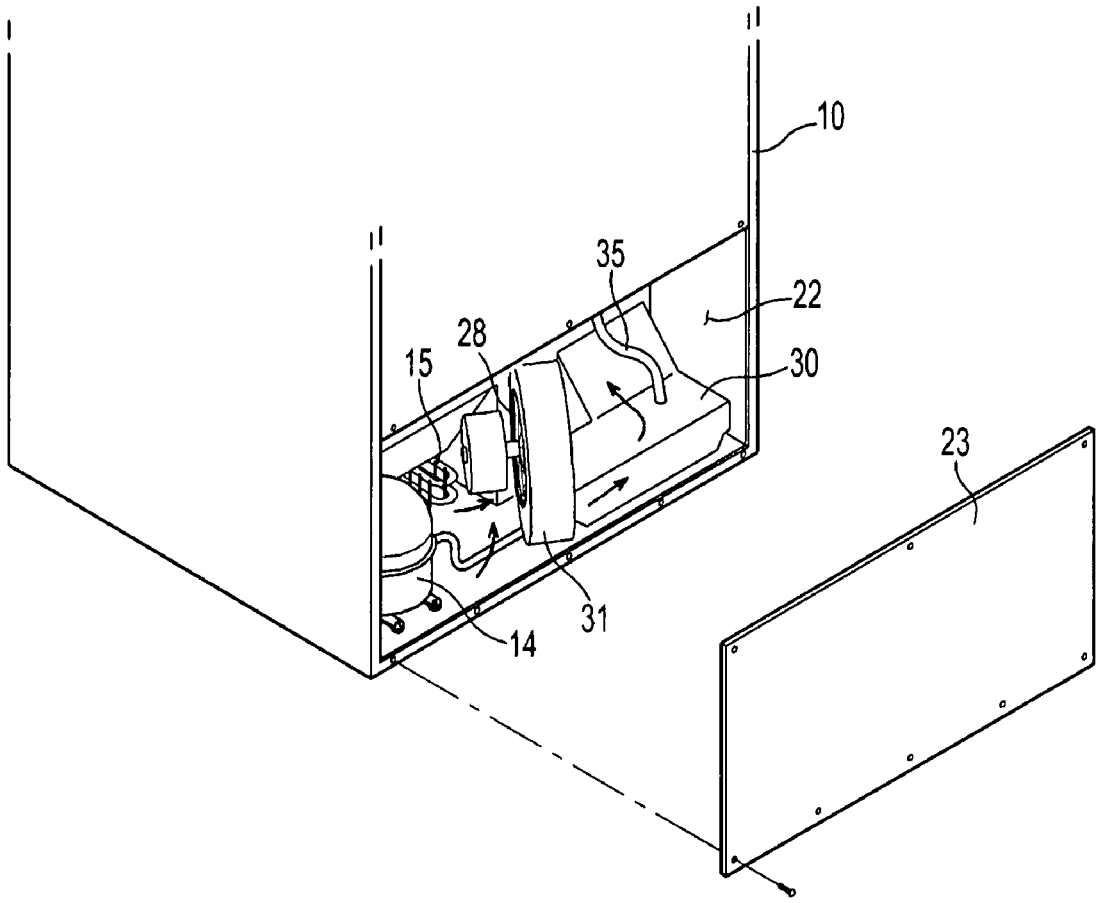
FIG. 2 is a perspective view illustrating a machine room of a refrigerator according to the present embodiment.

As illustrated in FIGS. 1 and 2, a machine room 22 partitioned from the storing chamber 11 is installed at a lower rear portion of the body 10. The machine room 22 may be opened or closed by a rear cover 23.

Figure 3:
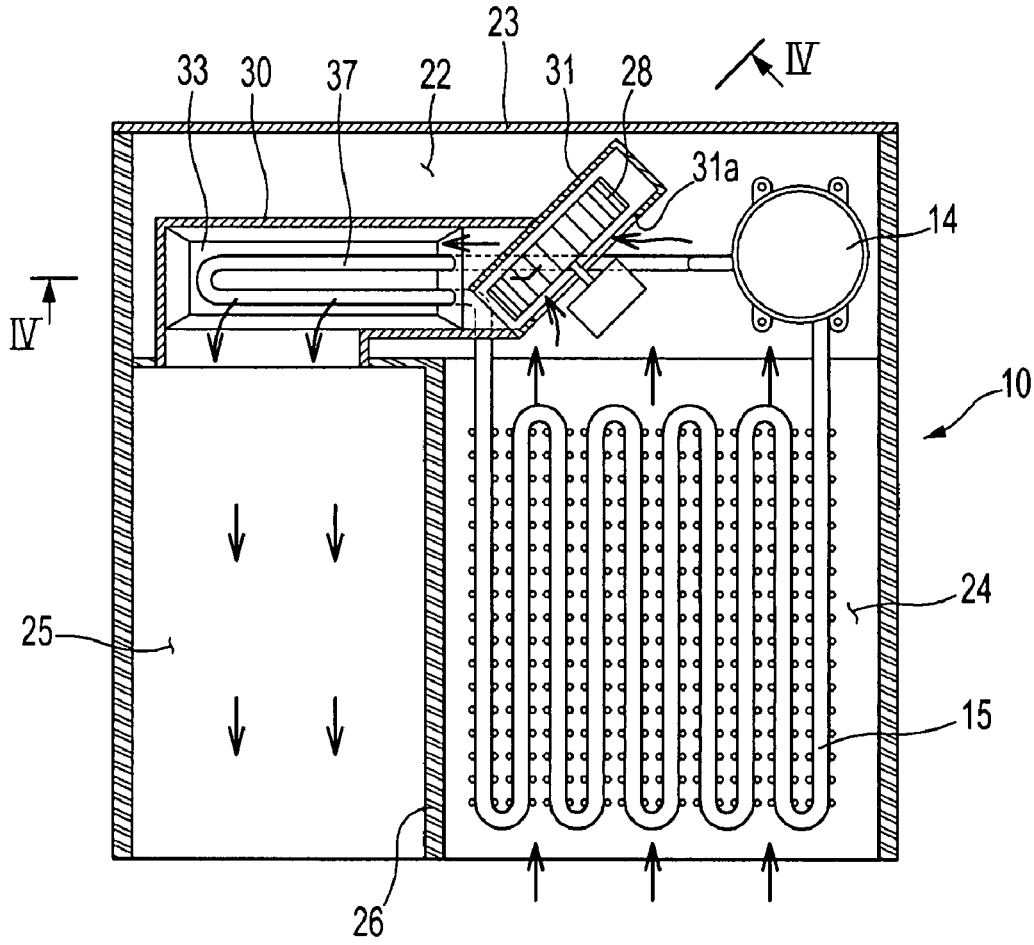
FIG. 3 is a sectional view taken along line III-III of FIG. 1.

As illustrated in FIGS. 1 and 3, both an air feeding path 24 to guide external air to the machine room 22, and an air exhausting path 25 to exhaust the air of the machine room 22 are installed at the lower portion of the body 10. As illustrated in FIG. 3, the air feeding path 24 and the air exhausting path 25 extend in front and rear directions of the body 10 so as to allow the inside of the machine room 22 to communicate with the lower front portion of the body 10, and the paths 24, 25 are partitioned from each other by a partition 26.

The condenser 15 is installed in the air feeding path 24, and the compressor 14 is installed in the machine room 22 adjacent to the outlet of the air feeding path 24. The machine room 22 is provided with a blowing fan 28 and a blowing guide duct 30. The blowing fan 28 intakes the air from the air feeding path 24 and blows the air to the air exhausting path 25, and the blowing guide duct 30 guides the air blown by the blowing fan 28 to the air exhausting path 25. Thus, as the blowing fan 28 is driven, air is introduced into the machine room 22 of the air feeding path 24, so that the condenser 15 and the compressor 14 can be cooled. Further, the air of the machine room 22, which has undergone heat exchange with the condenser 15 and the compressor 14, can be exhausted to the air exhausting path 25 through the blowing guide duct 30.

Figure 4:
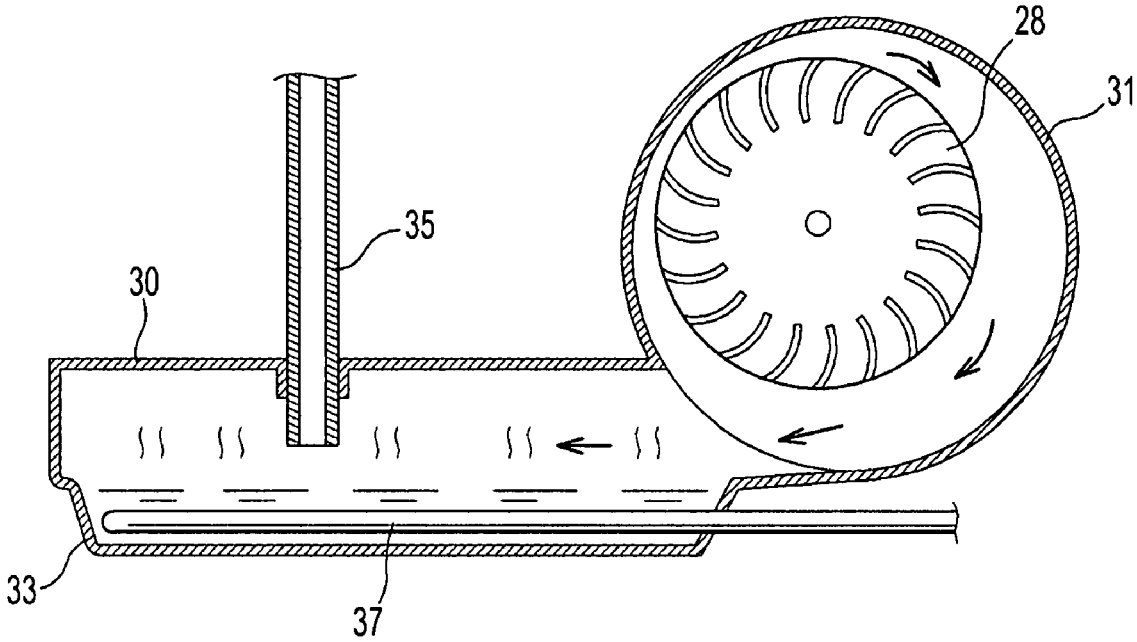
FIG. 4 is a sectional view taken along line IV-IV of FIG. 3.

As illustrated in FIGS. 3 and 4, the blowing fan 28 includes a sirocco (multi-wing) centrifugal fan. The blowing guide duct 30 has a cylindrical shape to surround the blowing fan 28, and includes a fan casing 31 formed at one side thereof with an inlet 31*a* to intake air. Thus, the air blown by the blowing fan 28 can be guided to the blowing guide duct 30 through the fan casing 31. Although the present embodiment has been described such that the blowing fan 28 includes a centrifugal fan, the blowing fan 28 may also include a conventional axial flow fan.

As illustrated in FIG. 4, an evaporating dish 33 is installed in a lower portion of the blowing guide duct 30 in order to collect and evaporate defrost water. The evaporating dish 33 is formed over an entire area of a lower surface of the blowing guide duct 30, thereby defining the lower portion of the blowing guide duct 30. A defrost water guide pipe 35 is installed in an upper portion of the blowing guide duct 30 in order to guide defrost water flowing from the evaporator 16 into the evaporating dish 33. As illustrated in FIG. 1, the defrost water guide pipe 35 is connected to a cold air path 21 in a lower portion of the evaporator 16. Thus, the defrost water flowing along the cold air path 21 from the evaporator 16 can be guided into the evaporating dish 33 through the defrost water guide pipe 35 when the defrosting operation is performed by the evaporator 16.

As illustrated in FIGS. 3 and 4, the evaporating dish 33 is provided with a refrigerant pipe 37 having a high temperature and being connected to the compressor 14 in order to evaporate the defrost water. The refrigerant pipe 37 passes through the evaporating dish 33, so that the defrost water can be heated by the refrigerant pipe 37, and thus the defrost water can be evaporated.

As illustrated in FIG. 4, the evaporating dish 33 has an opened upper portion to communicate with the path of the blowing guide duct 30, and is integrally formed with the blowing guide duct 30 through resin injection molding. If the evaporating dish 33 is integrally formed with the blowing guide duct 30 as described above, since a separate process to manufacture the evaporating dish 33 is not necessary, the evaporating dish 33 can be easily fabricated at a low cost. In addition, since an assembly process to install the evaporating dish 33 is not necessary, a manufacturing process for the refrigerator can be simplified.

According to such a structure, the air blowing inside the blowing guide duct 30 by the operation of the blowing fan 28 quickly flows along the surface of the defrost water contained by the evaporating dish 33, so that the evaporation efficiency of the defrost water can be improved. That is, the speed of the air flowing along the surface of the defrost water becomes fast, so that convection-heat transfer for evaporation of the defrost water can be improved.

Further, since the evaporation efficiency of the defrost water is improved, the size of the evaporating dish 33 is reduced, so that the space of the machine room 22 occupied by the evaporating dish 33 is also reduced. In this way, the inner space of the machine room 22 can be effectively utilized.

According to such a structure, the air blown by the blowing fan 28 is completely exhausted to the air exhausting path 25 while being guided by the blowing guide duct 30, and thus air circulation in the machine room 22 can be improved, so that the cooling efficiency of the compressor 14 and the condenser 15 can also be improved.

Hereinafter, an air circulation operation in the machine room will be described.

As illustrated in FIG. 3, as the blowing fan 28 operates, the air is introduced from the front of the body 10 into the machine room 22 through the air feeding path 24. Here, the air introduced into the machine room 22 cools the condenser 15 in the air feeding path 24 and the compressor 14 in the machine room 22. Accordingly, the air existing in the machine room 22 above the blowing fan 28 has a temperature higher than that of the external air. The air of the machine room 22 having the high temperature is exhausted to the air exhausting path 25 while being guided by the blowing guide duct 30, and the air of the air exhausting path 25 is exhausted to the front of the body 10.

The air flowing inside the blowing guide duct 30 quickly flows along the surface of the defrost water contained by the evaporating dish 33. In this way, heat transfer by convection is improved, so that the defrost water is quickly evaporated. Further, the refrigerant pipe 37 having the high temperature and being immersed in the defrost water heats the defrost water, so that the defrost water is more quickly evaporated.

According to a refrigerator of the present embodiment as described above, an evaporating dish is installed at the lower portion of a blowing guide duct in order to cause the upper surface of defrost water in the evaporating dish to make contact with the air flowing inside the blowing guide duct, so that convection-heat transfer can be improved, and thus the defrost water can be quickly evaporated.

Further, according to the present embodiment, since it is possible to improve the evaporation efficiency of the defrost water, the size of the evaporating dish can be reduced and a space occupied by the evaporating dish can be minimized.

Furthermore, according to the present embodiment, since the evaporating dish is integrally formed with a blowing guide duct, the evaporating dish can be easily manufactured at the low cost. In addition, since an assembling process to install the evaporating dish is not necessary, the manufacturing process for the refrigerator can be simplified.

Moreover, according to the present embodiment, since the air blown by a blowing fan is completely exhausted to an air exhausting path while being guided by the blowing guide duct, air circulation in a machine room can be improved. Consequently, the cooling efficiency of a compressor and a condenser can be improved.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A refrigerator, comprising:

a cooling apparatus including at least a compressor, a condenser, and an evaporator;

a machine room, the compressor and condenser being positioned in an inner space of the machine room;

an air feeding path provided to feed exterior air into the machine room;

an air exhausting path provided to exhaust the air to an exterior of the machine room;

a blowing fan blowing air, an inlet of the blowing fan being adjacent to the compressor and the condenser so that air sucked into the blowing fan cools the compressor and the condenser; and a blowing guide duct arranged in the machine room, an inlet of the blowing guide duct being connected to an outlet of the blowing fan and an outlet of the blowing guide duct being connected to the air exhausting path of the refrigerator so that the blowing guide duct defines a separate air path in the inner space of the machine room, thereby guiding the air from the blowing fan only to the air exhausting path without flowing the air toward the entire of the machine room.

2. The refrigerator as claimed in claim 1, further comprising an evaporating dish installed in a lower portion of the blowing guide duct in order to collect and evaporate defrost water, the evaporating dish having an opened upper portion to communicate with a path of the blowing guide duct, wherein the evaporating dish is integrally formed with the blowing guide duct.

3. The refrigerator as claimed in claim 1, wherein the evaporating dish comprises a refrigerant pipe to heat the defrost water.

4. The refrigerator as claimed in claim 1, wherein the blowing guide duct comprises a defrost water guide pipe guiding the defrost water into the evaporating dish.

5. The refrigerator as claimed in claim 1, wherein the blowing fan includes a centrifugal fan, and the blowing guide duct includes a fan casing surrounding the blowing fan.

6. A refrigerator comprising:

a body having a storing chamber;

a machine room installed at a lower rear portion of the body and partitioned from the storing chamber, the machine room having an inner space;

an air feeding path formed in a lower portion of the body to introduce external air into the machine room;

a condenser installed in the air feeding path;

a compressor installed at an outlet of the air feeding path in the machine room;

a blowing fan installed in the machine room, an inlet of the blowing fan being adjacent to the compressor so that air sucked into the blowing fan cools the compressor; and a blowing guide duct arranged in the machine room to define a separate air path in the inner space of the machine room, an inlet of the blowing guide duct being connected to an outlet of the blowing fan and an outlet of the blowing guide duct being connected to an air exhausting path formed in the lower portion of the body to exhaust the air out of the machine room, thereby guiding the air from the blowing fan only to the air exhausting path without flowing the air toward the entire of the machine room.

7. The refrigerator as claimed in claim 6, further comprising an evaporating dish installed in a lower portion of the blowing guide duct in order to collect and evaporate defrost water, the evaporating dish having an opened upper portion to communicate with a path of the blowing guide duct, wherein the evaporating dish is integrally formed with the blowing guide duct.

8. The refrigerator as claimed in claim 6, wherein the evaporating dish comprises a refrigerant pipe to heat the defrost water.

9. The refrigerator as claimed in claim 6, wherein the blowing guide duct comprises a defrost water guide pipe guiding the defrost water into the evaporating dish.

10. The refrigerator as claimed in claim 6, wherein the blowing fan includes a centrifugal fan, and the blowing guide duct includes a fan casing surrounding the blowing fan.

* * * * *